US006550827B1

(12) United States Patent
Tsujino

(10) Patent No.: US 6,550,827 B1
(45) Date of Patent: Apr. 22, 2003

(54) CLOSING DEVICE OF HINGED DOOR

(75) Inventor: Jun-ichi Tsujino, Osaka (JP)

(73) Assignee: Kabushiki Kaisha Systech Kyowa, Osaka (JP)

( * ) Notice: Subject to any disclaimer, the term of this patent is extended or adjusted under 35 U.S.C. 154(b) by 0 days.

(21) Appl. No.: 09/914,626

(22) PCT Filed: Mar. 1, 2000

(86) PCT No.: PCT/JP00/01187

§ 371 (c)(1),
(2), (4) Date: Aug. 31, 2001

(87) PCT Pub. No.: WO00/52289

PCT Pub. Date: Sep. 8, 2000

(30) Foreign Application Priority Data

Mar. 2, 1999 (JP) ..... 11-053488

(51) Int. Cl.[7] ..... E05C 21/02
(52) U.S. Cl. ..... 292/252; 292/341.15; 292/341.17
(58) Field of Search ..... 29/252, 341.15, 29/341.17, 230; 70/465

(56) References Cited

U.S. PATENT DOCUMENTS

| | | | | |
|---|---|---|---|---|
| 5,152,562 A | * | 10/1992 | Stevenson et al. | 292/252 |
| 5,518,282 A | * | 5/1996 | Sawada | 292/128 |
| 5,697,655 A | * | 12/1997 | Strong | 292/230 |
| 6,010,168 A | * | 1/2000 | Johnson | 292/207 |

FOREIGN PATENT DOCUMENTS

| | | | | |
|---|---|---|---|---|
| JP | 1995967970 A | * | 8/1995 | |
| JP | 8-322663 A | | 12/1996 | |
| JP | 10-165249 A | | 6/1998 | |
| JP | 10-18416 A | | 7/1998 | |
| JP | 10-238197 A | | 9/1998 | |
| JP | 411044141 A | * | 2/1999 | |
| JP | 2000096902 A | * | 4/2000 | E05C/21/02 |
| JP | 2000220337 A | * | 8/2000 | E05C/19/16 |
| JP | 20000274133 A | * | 10/2000 | E05C/19/08 |
| JP | 2000325167 A | * | 11/2000 | A47B/96/00 |
| JP | 2001020582 A | * | 1/2001 | E05C/19/08 |

* cited by examiner

*Primary Examiner*—Anthony Knight
*Assistant Examiner*—Mark Williams
(74) *Attorney, Agent, or Firm*—Smith Patent Office

(57) ABSTRACT

A closing device of a hinged door, wherein a locking body (38) is disposed upward-movably at an opening (36) with a flange part **(38*b*) larger than the opening (36) positioned inside a case (33) installed on a storing device main body (31), a spherical body (37) is stored in each moving space (34) in the case (33), and an elastic piece (43) which forms a locking path (42) at the tip of a supporting body (41) on a hinged door (32) side, forms an ascending sloped surface (43*a*), and has a tip side having an upward elastic force larger than the weight of a locking body (38) is formed integrally in front of the locking part (42) of the supporting body (41), whereby at least one spherical body (37) is put on the upper surface of flange part (38*b*) so as to stop the locking body (38) from moving upward at the time of earthquake, and the locking body (38) pushes down the elastic piece (43) so as to enable it to be locked to the locking part (42) to control the hinged door (32)** to a degree that it can be opened slightly.

12 Claims, 3 Drawing Sheets

CLOSING DEVICE OF HINGED DOOR

TECHNICAL FIELD

This invention relates to a closing device of a hinged door provided in a storing device equipped with a hinged door, such as a piece of furniture or a suspended cupboard, and adapted to restrict the opening of the hinged door at the time of an earthquake and, in particular, to a structure restricting the opening of a hinged door at the time of an earthquake.

BACKGROUND ART

In a storing device equipped with a hinged door, such as a piece of furniture or a suspended cupboard, there is provided a closing device for normally restricting the opening of the hinged door at the time of an earthquake in order to prevent the hinged door from being opened by the shaking of the earthquake to allow the things stored therein to fall. In a closing device of this type, a locking means provided in the storing device main body is hidden in a case in the normal condition. By the shaking of an earthquake, this locking means protrudes downward from the case, and the locking means thus protruding is engaged with a locking gadget provided on the hinged door to thereby restrict the opening of the hinged door, thereby preventing the stored objects from falling.

Specific examples of such a device are described in Japanese Patent Application Laid-open No. Hei 8-322663, Japanese Patent Application Laid-open No. Hei 10-165249, etc. In one example, in the normal condition, a spherical body is positioned under a stopper of a locking means to thereby prevent downward movement of the locking means and maintain the locking means in a state in which it is hidden in a case. At the time of an earthquake, the spherical body rolls to depart from the position under the stopper of the locking means, whereby downward movement of the locking means is allowed.

However, in the above-described conventional closing device, the hinged door is locked in a half-open state, i.e., it is left slightly ajar. Thus, when the earthquake is over, it is necessary to perform a special canceling operation to cancel this locked state, which is very inconvenient.

Further, since the amount by which the locking means is vertically displaced is very large, the entire device has to be large and thick. When the width of the frame forming the hinged door is 4 to 5 cm at the most, as in the case in which a glass plate is fitted into the hinged door, a part of the closing device including the locking means is visible through the glass of the closed hinged door, resulting in a rather unsightly appearance.

It is an object of this invention to provide a small and thin closing device of a hinged door which eliminates the need for the canceling operation after earthquake and which can reliably prevent the hinged door from opening during earthquake.

DISCLOSURE OF THE INVENTION

In accordance with the present invention, there is provided a closing device of a hinged door which is provided in a storing device with a hinged door, such as a piece of furniture or a suspended cupboard, for restricting the opening of the hinged door at the time of an earthquake, the closing device being characterized by including: a case having a space therein and provided in a main body of the storing device; an opening formed in a bottom surface of the case; a locking member having at its top a flange portion larger than the opening and arranged in the opening so as to be upwardly movable, with the flange portion being situated inside the case; a plurality of moving spaces defined by dividing the space inside the cases; and a plurality of rolling members respectively accommodated in the moving spaces so as to be movable and adapted to be placed on the upper surface of the flange portion by a shaking force to thereby prevent upward movement of the locking member.

With this construction, under the normal condition, the locking member is capable of both upward and downward movements, so that if there is an obstacle below the locking member, the locking member can be passed over the obstacle by upward/downward movement when opening/closing the hinged door. Thus, the opening/closing of the hinged door is not restricted in any way.

At the time of an earthquake, only when upward movement of the locking member is prevented by preventing means and the locking member is prevented from moving, the locking member can be locked at one side of the hinged door, the movement of the hinged door being restricted to such a degree that the door can be slightly opened.

In this case, the plurality of rolling members accommodated in the moving spaces within the case function as the above-mentioned preventing means, and one of the rolling members is placed on the upper surface of the flange portion of the locking member by the shaking of an earthquake, whereby upward movement of the locking member is prevented.

Thus, according to the present invention, it is only necessary for the locking member to be capable of being locked at the hinged door when upward movement of the locking member is prevented, and the amount of movement in the vertical direction of the locking member may be small, whereby a reduction in the size and thickness of the device can be achieved, and even when a glass plate is fitted into the hinged door, the closing device is not easily seen through the glass, thereby making it possible to provide a storing device having a very satisfactory outward appearance. Further, by providing a plurality of rolling members, it is possible to cope with various types of earthquake shaking since one of the rolling members reacts to each particular type of shaking, whereby it is possible to reliably prevent upward movement of the locking member.

When the hinged door is provided with a restricting means which makes the locking of the locking member possible only when the movement of the locking member is prevented when opening or closing the door and restricts the opening of the hinged door to such a degree that it is slightly opened, the locking member can be locked to the restricting means only when the movement of the locking member is prevented at the time of an earthquake, so that during the earthquake, upward movement of the locking member is continuously prevented, and when the earthquake is over, upward movement of the locking member is not prevented by the rolling members. Thus, there is no need to perform a canceling operation after the earthquake as in the prior art, and it is possible to reliably prevent the hinged door from opening during earthquake, thus making it possible to provide a storing device which is highly reliable and user-friendly.

Further, the restricting means includes a support member supported by the hinged door, a locking portion formed at the forward end of the support member and having an inclined surface sloping down in the closing direction of the hinged door, and an elastic member which is provided in the portion of the support member in front of the locking portion, whose forward end is biased by an upward biasing force larger than the weight of the locking member, and which has an inclined surface sloping down in the opening direction of the hinged door, whereby, in the normal condition, as the hinged door is opened, the locking member moves upwardly along the inclined surface of the elastic member, and, as the hinged door is closed, the locking member moves upwardly along the inclined surface of the locking portion; at the time of an earthquake, at least one of the rolling members is placed on the upper surface of the flange portion, whereby a state is achieved in which upward movement of the locking member is prevented and in which the locking member can be engaged with the locking portion while pushing down the elastic member, thereby making it possible to restrict the movement of the hinged door to such a degree that it is slightly opened.

In this way, the support member supported by the hinged door, the locking portion formed on the support member, and the elastic member provided in front of the locking portion of the support member function as the restricting means, restricting the movement of the hinged door at the time of an earthquake to such a degree that it can be slightly opened.

In the present invention, the forward end portion of the elastic member has an inclined surface biased by an upward biasing force larger than the weight of the locking member and sloping down in the opening direction of the hinged door, so that, in the normal condition, as the hinged door is opened, the locking member climbs the inclined surface of the elastic member and moves upward, and, as the hinged door is closed, the locking member climbs the inclined surface of the locking portion and moves upward; at the time of an earthquake, at least one of the rolling members is placed on the upper surface of the locking member, whereby upward movement of the locking member is prevented. Thus, a state is achieved in which the locking member can be engaged with the locking portion while pushing down the elastic member.

When the earthquake is over, the rolling member placed on the upper surface of the locking member rolls to cancel the prevention of upward movement of the locking member, and the device is restored to a state which is the same as that in the normal condition without having to perform any special canceling operation.

In this way, in accordance with the present invention, when the earthquake is over, the rolling member placed on the upper surface of the locking member rolls to cancel the prevention of upward movement of the locking member, and the device can be restored to a state which is the same as that in the normal condition without having to perform any special canceling operation.

In order that the rolling member may easily roll and drop from the upper surface of the flange portion of the locking member when the device is not being shaken, it is desirable to incline the upper surface of the flange portion slightly outward.

Further, in the present invention, the rolling members may be spherical members. This makes it possible to cope with various type of earthquake shaking, and facilitates the handling, enabling the rolling members to be easily accommodated in the case.

BEST MODE FOR CARRYING OUT THE INVENTION

Figure 2:
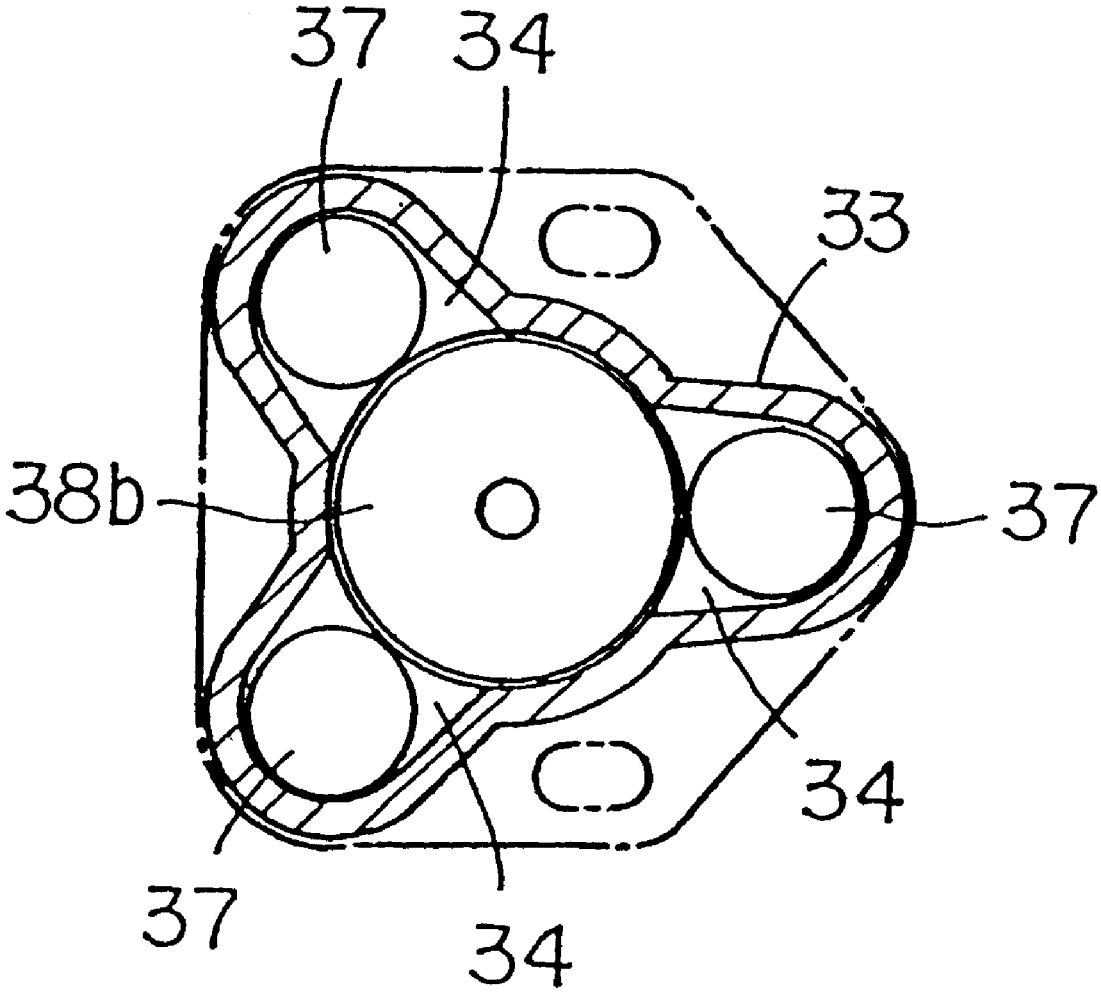
FIG. 2 is a partial sectional plan view of an embodiment of this invention.
Figure 3:
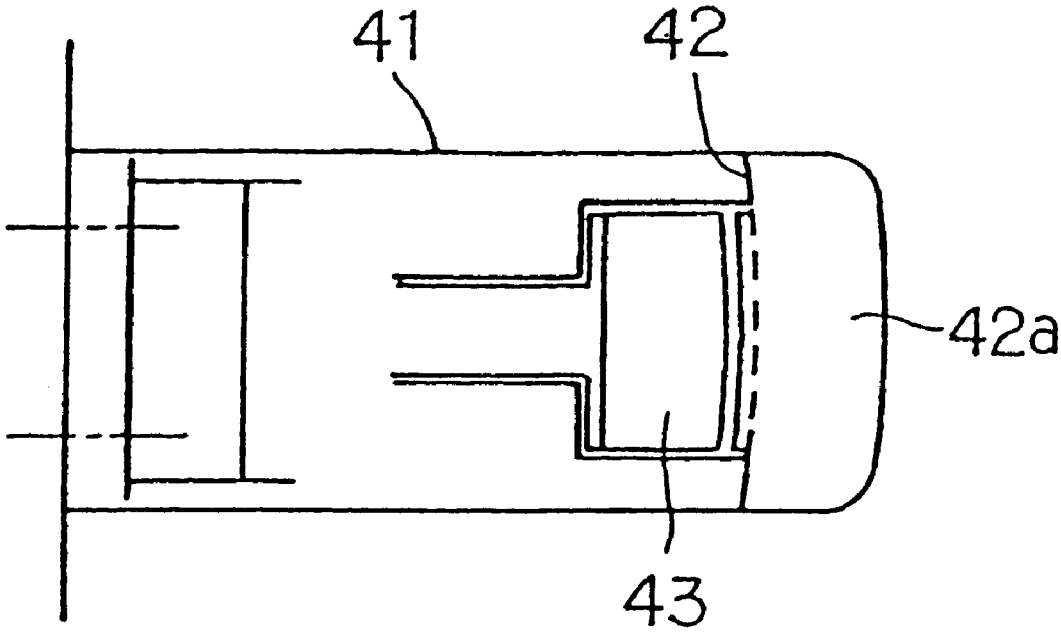
FIG. 3 is a plan view of a different part of an embodiment of this invention.

An embodiment of this invention will be described with reference to FIGS. 1 through 3.

Figure 1:
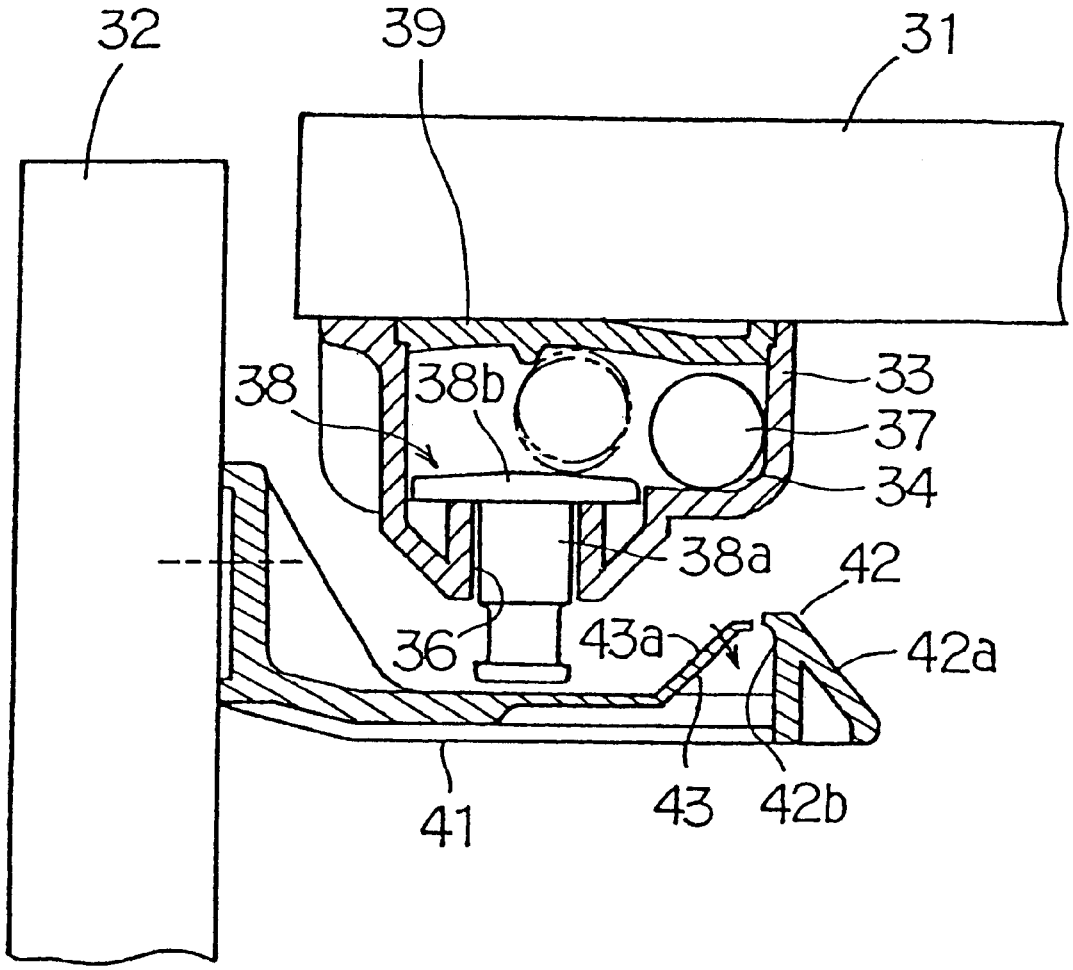
FIG. 1 is a front sectional view of an embodiment of this invention.

In FIG. 1, reference numeral 31 indicates the main body of a storing device equipped with a hinged door, such as a piece of furniture or a suspended cupboard, reference numeral 32 indicates a hinged door, and reference numeral 33 indicates a case formed of a resin or the like. As is also shown in FIG. 2, the case contains a space, which is divided into three portions to define three moving spaces 34, and a flange at the upper end is mounted to the storing device main body 31 by means of screws or the like.

Reference numeral 36 indicates an opening formed in the bottom surface of the case, and reference numeral 37 indicates three spherical members constituting the rolling members, which are movably accommodated in the respective moving spaces 34. The moving spaces 34 are formed such that each of the spherical members 37 is only capable of moving within its moving space 34 and cannot enter the adjacent moving spaces 34.

Reference numeral 38 indicates a locking member formed of a resin or the like and composed of a substantially cylindrical base portion 38*a* and a flange portion formed at the upper end of the base portion 38*a* and larger than the opening 36. The flange portion 38*b* is accommodated in the case 33, and the base portion 38*a* is arranged so as to be vertically movable in the opening 36. The locking member 38 is arranged such that when it moves downward, its lower end portion protrudes downwardly from the case 33. Further, in order that, when there is no shaking, the spherical members 37 may easily roll and fall from the upper surface of the flange portion 38*b* of the locking member 38, the upper surface of the flange portion 38*b* is slightly inclined outward.

Then, a cover 39 totally or partially closing the case 33 is attached to the upper surface of the case 33. The clearance between the lower surface of the cover 39 and the upper surface of the flange portion 38*b* of the locking member 38 at its lowest position is set to be somewhat larger than the diameter of the spherical members 37, and the peripheral edge of the upper surface of the flange portion 38*b* of the locking member 38 at its lowest position is set to be slightly higher than the bottom surface of the case 33.

Due to this construction, when the shaking of an earthquake is applied to the device, one of the spherical members 37 can be placed on the upper surface of the flange portion 38*b* and held between the lower surface of the cover 39 and the upper surface of the flange portion 38*b* of the locking member 38, whereby upward movement of the locking member is prevented. Substantially at the center of the lower surface of the cover 39, there is formed a protrusion, and, due to the presence of this protrusion, each spherical member 37 cannot enter the adjacent moving spaces 34. In this way, each spherical member 37 is caused to operate by the shaking of an earthquake and functions as a preventing means for preventing upward movement of the locking member 38.

Reference numeral 41 indicates a support member which is formed of a resin and whose left end portion is fastened to the hinged door 32 by means of screws or the like. Reference numeral 42 indicates a locking portion which is formed at the right-hand end of the support member 41 and which has on the right-hand side an inclined surface 42a sloping down in the closing direction of the hinged door 32 and on the left-hand side a vertical surface 42*b*. Reference numeral 43 indicates an elastic member, which is, as shown in FIGS. 1 and 3, formed integrally with the support member 41 substantially at the center thereof, with its end being raised by approximately 45 degrees. The elastic member 43 is arranged in front of the locking portion 42, and its forward end portion has an upward elastic force larger than the weight of the locking member 38.

The support member 41, the locking portion 42, and the elastic member 43 function as a restricting means. The elastic member 43 forms an inclined surface 43a sloping down in the opening direction of the hinged door 32. Thus, when there is no earthquake shaking, the locking member 38 comes into sliding contact with the inclined surface 43*a* when the hinged door 32 is opened, and, due to the elasticity of the elastic member, the locking member 38 is passed over the elastic member 43 and the locking portion 42. When there is any shaking, the hinged door 32 is prevented from being fully opened because the locking member 38, which is then prevented from upwardly moving by the spherical member 37, pushes down the elastic member 43, and the lower end portion 38 of the locking member 38 abuts the vertical surface 42*b* on the left-hand side of the locking portion 42, restricting the movement of the hinged door 32 to such a degree that it can be slightly opened.

Next, the operation of the device will be described. In the normal condition, upward movement of the locking member 38 is not prevented, so that as the hinged door 32 is opened, the locking member 38 climbs the inclined surface 43*a* to move upward, and, as the hinged door 32 is closed, the locking member 38 climbs the inclined surface 42*a* of the locking portion 42 to move upward, thus allowing the hinged door 32 to be freely opened and closed.

At the time of an earthquake, at least one of the spherical members 37 is caused to come to be placed on the upper surface of the flange portion 38*b* of the locking member 38 by the shaking, and the spherical member 37 is held between the lower surface of the cover 39 and the upper surface 38*b* of the locking member 38 (as indicated by the chain line and the two-dot chain line in FIG. 1) , whereby the upward movement of the locking member 38 is prevented. While pushing down the elastic member 43, the lower end of the locking member 38 is brought into a state in which it can abut the vertical surface 42*b* of the locking portion 42. Through the engagement of the locking member 38 with the vertical surface 42*b*, the movement of the hinged door 32 is restricted to such a degree that it can be slightly opened. As a result of the elastic member 43 being pushed down, an upward biasing force due to the elastic member 43 is applied to the locking member 38. Thus, the spherical member 37 is firmly held between the lower surface of the cover 39 and the flange portion 38*b* of the locking member 38.

When the earthquake is over, the spherical member 37, which has been on the flange portion 38*b* of the locking member 38 rolls of itself toward the moving space 34 side due to the outward inclination of the flange portion 38*b*, so that the restriction of the movement of the locking member 38 is automatically canceled, and the forward end of the elastic member 43 is raised again due to its elastic force. Thus, the device is restored to the normal condition without having to perform any special canceling operation.

Thus, in the above-described embodiment, the locking member 38 can be engaged with the locking portion 42 when upward movement of the locking member 38 is prevented; since a slight vertical movement (e.g., approximately 5 mm) of the locking member 38 suffices, it is possible to achieve a reduction in the size and thickness of the device.

As a result, even if, as in the case where a glass plate is fitted into the hinged door 32, the width of the frame forming the hinged door 32 is 4 to 5 cm at the most, it is possible to prevent the size of the entire case 33 in the state in which the lower portion of locking member 38 protrudes from becoming larger than the width of the frame of the hinged door 32, so that the lower portion of the locking member 38 is not visible through the glass of the hinged door 32 closed, thereby providing a very satisfactory outward appearance.

Further, since three spherical members 37 are movably accommodated respectively in different moving places 34, it is possible to cope with various types of earthquake shaking. That is, no matter how the shaking occurs, one of the spherical members 37 reliably reacts thereto and is capable of preventing upward movement of the locking member 38. During the earthquake, upward movement of the locking member 38 is continuously prevented, and when the earthquake is over, the spherical member 37 moves immediately to cancel the prevention of upward movement of the locking member 38, so that there is no need to perform a canceling operation after the earthquake as in the prior art. Further, during earthquake, it is possible to reliably prevent the hinged door 32 from being opened.

The number of spherical members 37 is not restricted to three. The number may also be at least two or more as long as it is possible for one of the spherical members to be placed between the lower surface of the cover 38 and the upper surface of the flange portion 38*b* of the locking member 38 by the shaking of an earthquake to prevent upward movement of the locking member 38. In particular, when the number is two, it is desirable for the spherical members to be arranged so as to be movable in the directions in which the hinged door 32 is opened and closed.

Apart from the spherical members 37 described above, the preventing means may also consist of rolling members in the form of cylinders or the like. Any type of preventing means will do as long as it is caused to operate by the shaking of an earthquake to prevent upward movement of the locking member 38.

Further, the restricting means is not restricted to the one composed of the support member 41, the locking portion 42, and the elastic member 43. Any type of structure will do as long as it is supported by the hinged door 32, and engageable with the locking member 38 only when upward movement of the locking member 38 is prevented at the time of opening/closing of the hinged door 32, restricting the movement of the hinged door 32 to such a degree that it can be slightly opened.

Further, the present invention is not restricted to the above-described embodiment. Various modifications are possible without departing from the gist of the invention.

Industrial Applicability

As described above, the closing device of a hinged door of the present invention is suitably provided in a storing device with a hinged door, such as a piece of furniture or a suspended cupboard, restricting the opening of the hinged door at the time of an earthquake to prevent the objects accommodated therein from falling.

What is claimed is:

1. A closing device of a hinged door which is provided in a storing device with the hinged door, for restricting the opening of the hinged door at the time of an earthquake, the closing device comprising:

a case having a space therein and provided in a main body of said storing device, an opening formed in a bottom surface of said case;

a locking member having at its top a flange portion larger than said opening and arranged in said opening so as to be upwardly movable, with the flange portion being situated inside said case;

a plurality of moving spaces defined by dividing the space inside said case; and a plurality of rolling members respectively accommodated in said moving spaces so as to be movable and adapted to be placed on the upper surface of said flange portion by a shaking force to thereby prevent upward movement of said locking member.

2. A closing device of a hinged door according to claim 1, wherein said hinged door is provided with a restricting means adapted to become engageable with said locking member only when the movement of said locking member is prevented at the time of the opening/closing of said hinged door, thereby restricting the movement of said hinged door to such a degree that it can be slightly opened.

3. A closing device of a hinged door according to claim 2, wherein the restricting means includes a support member supported by said hinged door; a locking portion formed at the forward end of said support member and having an inclined surface sloping down in the closing direction of said hinged door; and an elastic member which is provided in the portion of said support member in front of said locking portion, whose forward end is biased by an upward biasing force larger than the weight of said locking member, and which has an inclined surface sloping down in the opening direction of said hinged door; that in the normal condition, as said hinged door is opened, said locking member moves upwardly along the inclined surface of said elastic member, and, as said hinged door is closed, said locking member moves upwardly along the inclined surface of said locking portion; and that at the time of an earthquake, at least one of said rolling members is placed on the upper surface of said flange portion of said locking member, whereby a state is achieved in which upward movement of said locking member is prevented and in which said locking member can be engaged with the locking portion while pushing down said elastic member, thereby restricting the movement of said hinged door to such a degree that said hinged door is slightly opened.

4. A closing device of a hinged door according to claim 3, wherein when the earthquake is over, said rolling member moves from the upper surface of said flange portion toward said moving space, thereby restoring the device to a state which is the same as the normal condition without having to perform any special canceling operation.

5. A closing device of a hinged door according to claim 4, wherein said rolling members are spherical members.

6. A closing device of a hinged door according to claim 3, wherein said rolling members are spherical members.

7. A closing device of a hinged door according to claim 2, wherein when the earthquake is over, said rolling member moves from the upper surface of said flange portion toward said moving space, thereby restoring the device to a state which is the same as the normal condition without having to perform any special canceling operation.

8. A closing device of a hinged door according to claim 7, wherein said rolling members are spherical members.

9. A closing device of a hinged door according to claim 2, wherein said rolling members are spherical members.

10. A closing device of a hinged door according to claim 1, wherein when the earthquake is over, said rolling member moves from the upper surface of said flange portion toward said moving space, thereby restoring the device to a state which is the same as the normal condition without having to perform any special canceling operation.

11. A closing device of a hinged door according to claim 10, wherein said rolling members are spherical members.

12. A closing device of a hinged door according to claim 10, wherein said rolling members are spherical members.

* * * * *